US006953903B2

(12) United States Patent
Berger et al.

(10) Patent No.: US 6,953,903 B2
(45) Date of Patent: Oct. 11, 2005

(54) SIGNAL TRANSFER APPARATUS

(75) Inventors: Mark J. Berger, New York, NY (US); Simon Berger, Long Beach, NY (US); Peter Zoltan, Maspeth, NY (US)

(73) Assignee: Securitech Group, Inc., Maspeth, NY (US)

( * ) Notice: Subject to any disclaimer, the term of this patent is extended or adjusted under 35 U.S.C. 154(b) by 391 days.

(21) Appl. No.: 10/227,025

(22) Filed: Aug. 22, 2002

(65) Prior Publication Data

US 2003/0043020 A1 Mar. 6, 2003

Related U.S. Application Data

(60) Provisional application No. 60/315,535, filed on Aug. 28, 2001.

(51) Int. Cl.[7] ..... H01H 27/06

(52) U.S. Cl. ..... 200/61.62; 200/61.7; 70/271; 70/280; 340/825.19

(58) Field of Search ..... 200/61.62–61.7; 70/271–273, 277–282; 340/825.19–825.31

(56) References Cited

U.S. PATENT DOCUMENTS

| | | | | | |
|---|---|---|---|---|---|
| 3,890,608 | A | * | 6/1975 | Peterson | 340/522 |
| 5,850,753 | A | * | 12/1998 | Varma | 70/278.7 |
| 5,925,861 | A | * | 7/1999 | Fromberg | 200/61.67 |
| 5,943,888 | A | * | 8/1999 | Lawson | 70/278.7 |
| 6,185,773 | B1 | * | 2/2001 | Goedde | 340/540 |
| 6,318,138 | B1 | * | 11/2001 | Mathews et al. | 70/278.7 |

* cited by examiner

*Primary Examiner*—Kyung Lee
(74) *Attorney, Agent, or Firm*—Abelman, Frayne & Schwab

(57) ABSTRACT

A signal transfer assembly supplies a signal to unlock a door by controlling a lock of the door. The signal transfer assembly includes a transfer strip assembly in the door frame for receiving a deactuation signal, for passing the deactuation signal to a transfer tip assembly in the door, and for passing the deactuation signal to the lock to unlock the lock.

24 Claims, 3 Drawing Sheets

FIG. 1
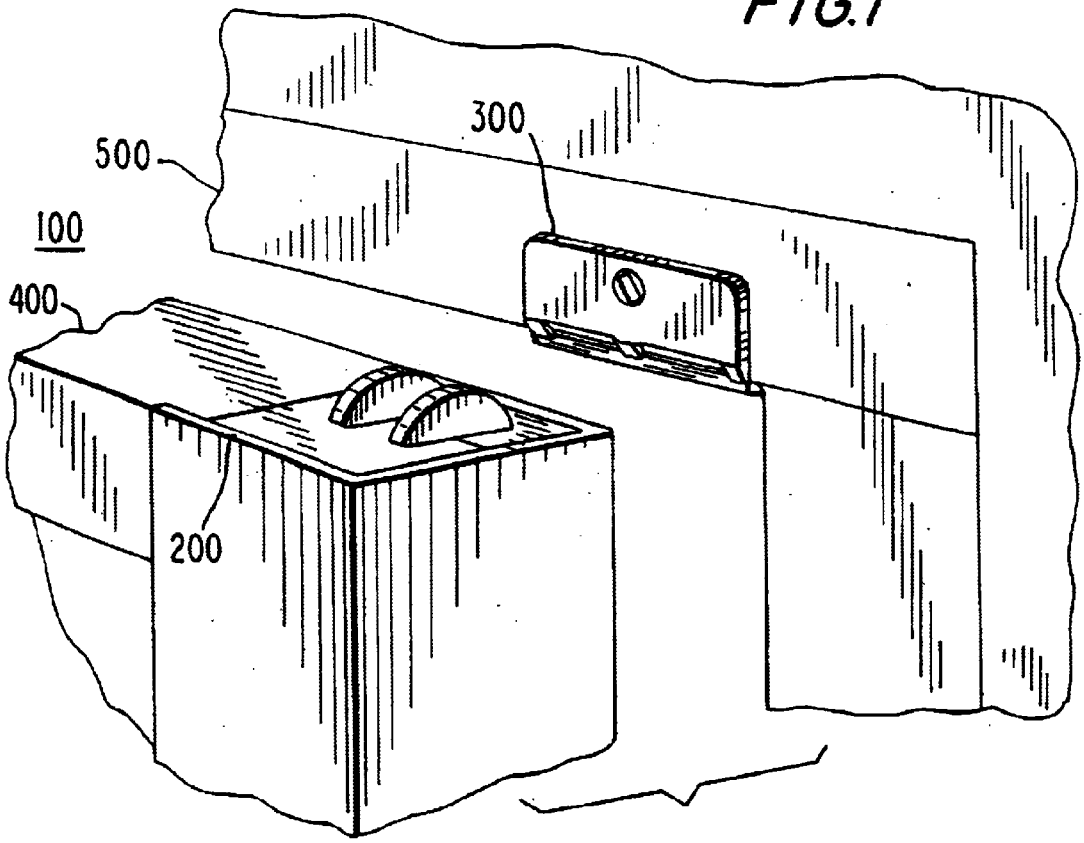
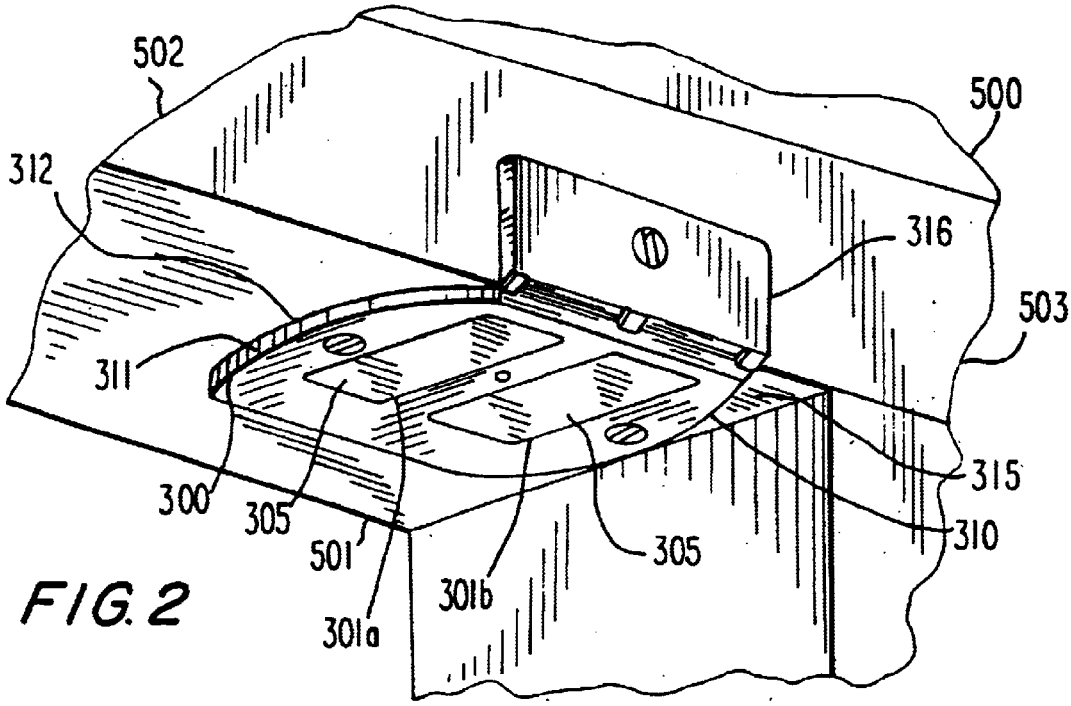
FIG. 2

FIG. 3
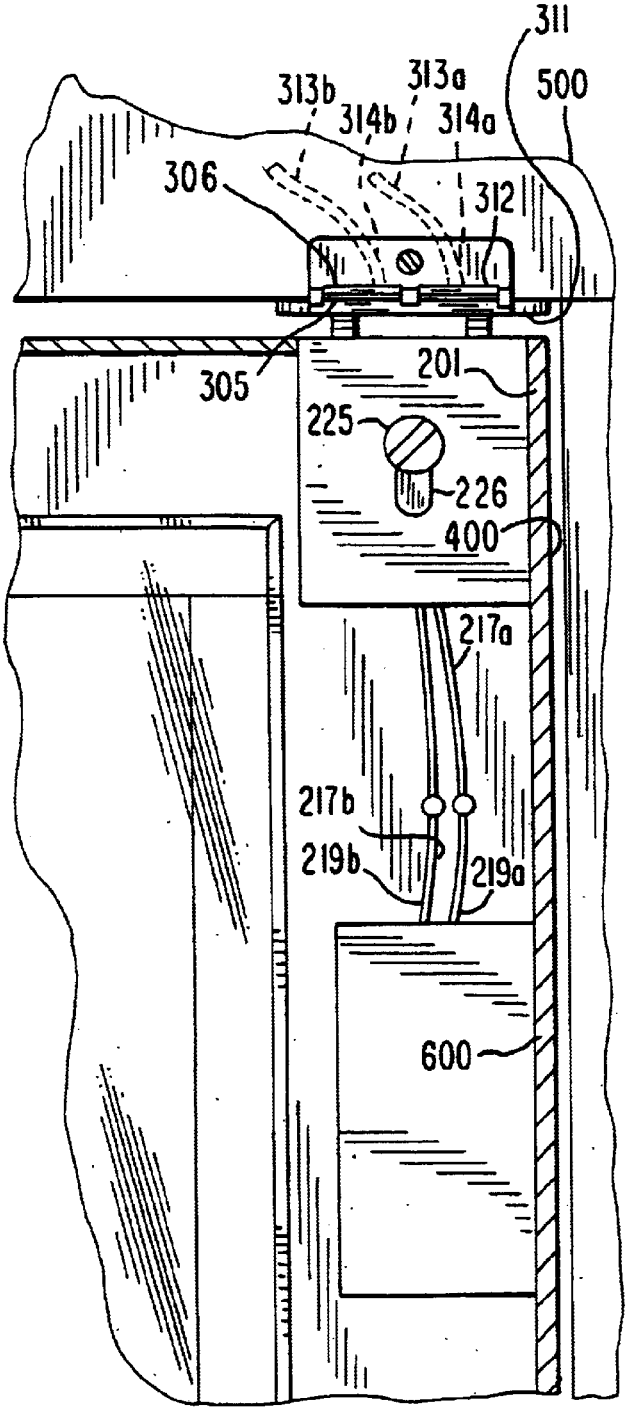
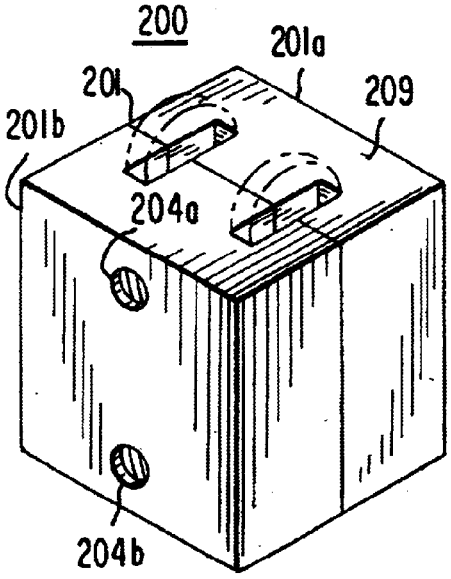
FIG. 4

FIG. 5
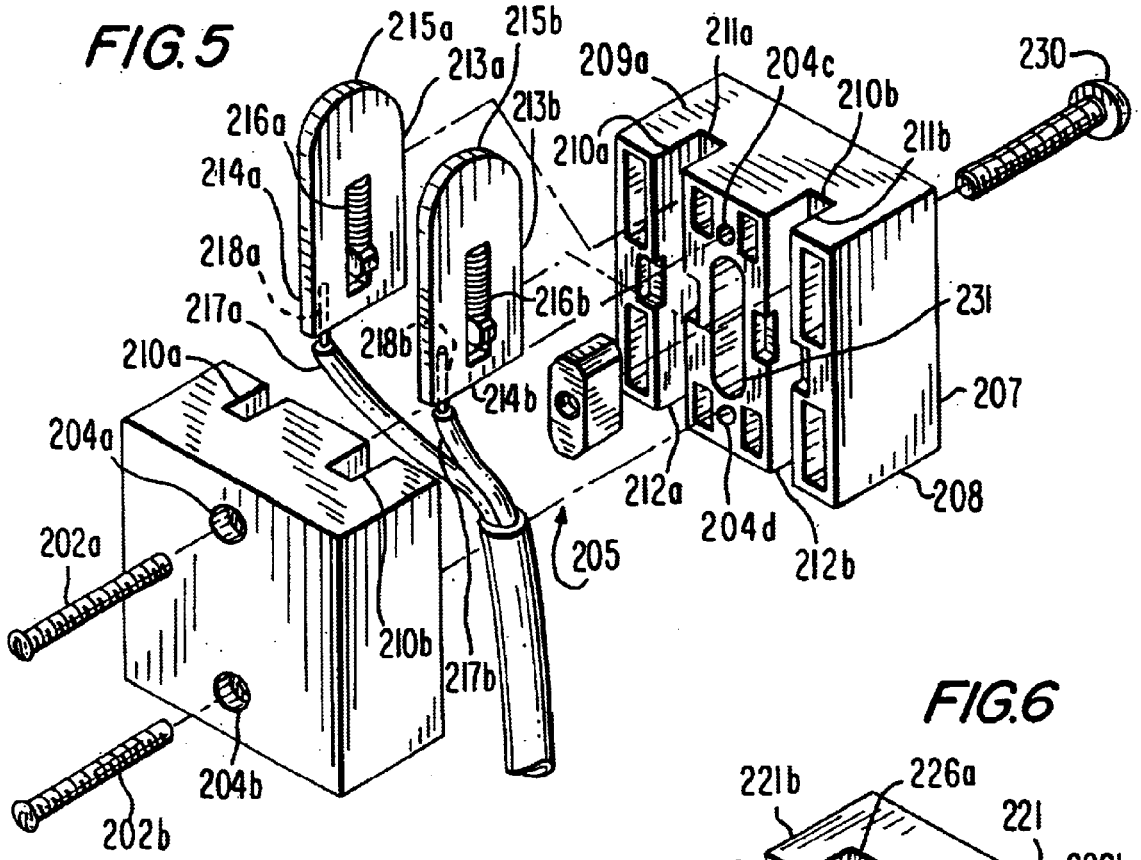
FIG. 6
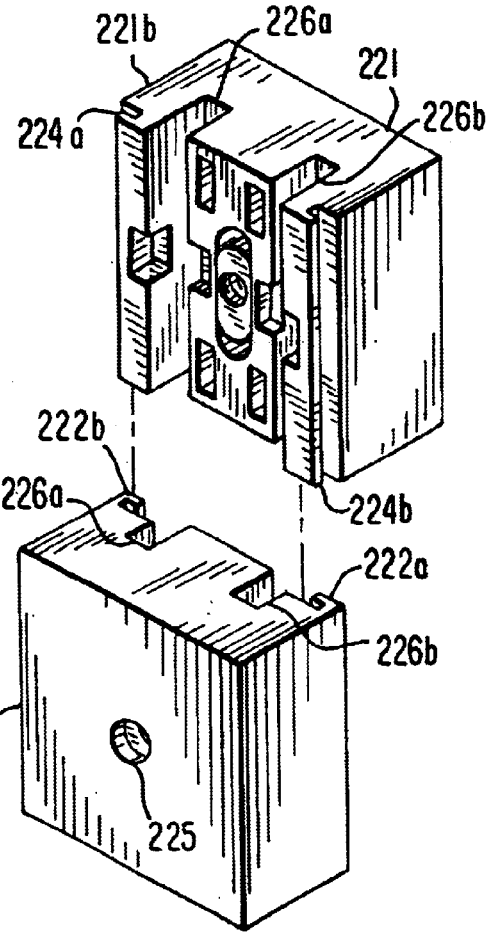
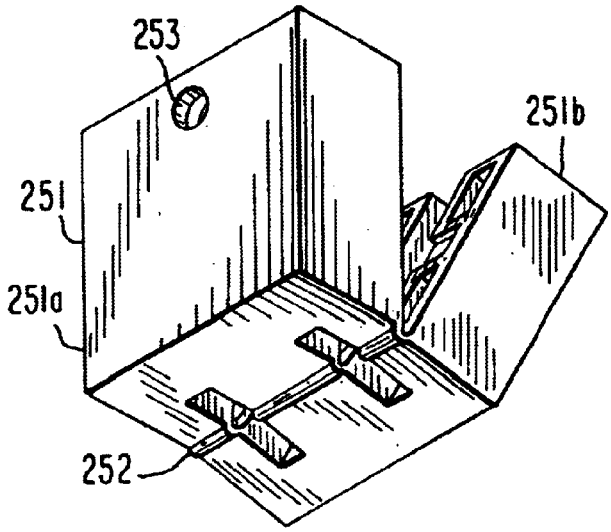
FIG. 7

SIGNAL TRANSFER APPARATUS

This application claims benefit of 60/315,535 filed on Aug. 28, 2001.

FIELD OF THE INVENTION

This invention relates broadly to the field of transferring an electrical signal or electrical power from a fixed component to a moving component. More particularly, the invention relates to remotely electro-mechanically deactuating two components of a mechanical system that cooperate with one another, wherein one component is fixed and the other is moveable, and the two components are capable of alternatively assuming a plurality of positions relative to one another, such as an open state and a closed state. Still more particularly, the invention relates to a device for remotely electro-mechanically unlocking a locked door having an electro-mechanically actuatable and deactuatable door locking mechanism.

BACKGROUND OF THE INVENTION

Heretofore, electro-mechanically actuated door lock release mechanisms, such as are used in security doors, have been made capable of remote opening in a number of ways. One method has been to provide a remotely actuatable electro-magnetic mechanism connected to the strike plate of a door lock, mounted in the door frame, which, when electrically actuated, causes an element in the strike plate to be mechanically withdrawn through operation of a magnetic force.

Another method has been to provide electrical power to an electro-mechanically actuatable door lock mechanism imbedded in the door, through an armored electrical cable, which enters the door from an upper portion of the frame, and runs through the core of the door, either in a hollow-core door, or through a channel in a solid core door, to the lock mechanism.

Certain doors include substantial surface portions that are made of glass and have outer frames, typically made from hollow tubular metal, such as aluminum or steel, which frames surround the glass panel portions and hold them in place. The metal frame portions of such doors are typically fairly narrow, frequently not exceeding two inches in width. Because the surfaces of these doors are substantially made entirely of solid glass, it is not possible to run a cable through the door, as can be done with hollow-core wood or metal doors, or even through a channel made in a solid wood door, running from the point of entry, such as in the aforesaid case of the armored cable, from the edge of the upper surface of the door inwardly to the lock mechanism.

It is impractical and unesthetical to run a wire, even encased in an armored cable, along either the inside or outside glass surfaces from an outer edge of the door to the door lock mechanism, which is located in the vicinity of the handle and trim. In a single pane solid glass door, it is necessary to have at least a portion of a hollow tubular outer surrounding door frame, extending around the outer periphery of the glass panel, extend at least to the vicinity of the door handle and locking mechanism, which is usually encased in a housing near a point at about a typical person's convenient hand-reach level, which is usually near the mid-point in the height of most doors that are from about 6 feet to about 8 feet in height, and can be at a point below the mid-point height of the door in the case of doors of greater height. There is a need in the art of locking mechanisms for doors, especially doors which have a substantial portion of their surfaces made from glass, or from other materials wherein their surfaces are substantially solid and not hollow, and which have relatively narrow frames surrounding the glass or other material, for providing a means for remotely electro-magnetically actuating the door lock mechanism, such that the actuating mechanism can be concealed in the tubular door frame, and such that the mechanism is connected to the door lock mechanism inside the door in the vicinity of the handle.

Such a situation as described above with respect to doors exists more generally in a wide variety of mechanical systems, wherein a second component that is movable is capable of assuming at least one first, fixed position with respect to a first, fixed component, and is held in that position by a fastener; and the second component is also capable of alternatively assuming at least one other, second position with respect to the first component, wherein the second component is movable with respect to the first component, after the fastener has been released using a remotely actuatable control device.

Thus, there is an issue in providing the deactuating electrical signal to the movable component at the position of the lock without using unsightly or cumbersome wiring.

SUMMARY OF THE INVENTION

Accordingly, the present invention provides a transfer assembly for transferring an electrical signal or electrical power from one location or component that is fixed to another location or component that is moveable. The transfer assembly apparatus of the present invention is an apparatus for remotely electro-mechanically controlling the state of two mechanical components that are capable of assuming a first position with respect to one another wherein the two mechanical components are held fixed with respect to one another by a mechanical fastening device, which is capable of being remotely electro-mechanically deactuated by an electro-mechanical control device; and at least one second position wherein the mechanical fastening device has been electro-mechanically deactuated so that the two mechanical components of the system are then capable of movement with respect to one another.

A typical application of the apparatus of the present invention is in a door system wherein the first and second mechanical components are a moving door and a stationary door frame, with the door having a mechanical locking means attached thereto, which cooperates with the door frame to hold the door in a closed, locked position, with the locking mechanism being capable of remote electro-mechanical deactuation so as to release the lock enabling the door to be moved relative to the frame.

The electromechanical door lock unlatching and release mechanism apparatus of the present invention is fabricated in a very compact size so as to be particularly suitable for use in door systems wherein the door has only very limited areas on which the mechanism can be mounted, such as a door having only, but at least, a portion thereof formed as a hollow tubular frame, with a substantially greater portion of the door's surface being of a solid material, such as glass, wood or metal, and where the door has a handle and locking mechanism mounted at or near an outer edge thereof proximate to the stationary door frame.

Other applications for the transfer assembly apparatus of the present invention include alarmed doors, windows, hatches, and the like.

BRIEF DESCRIPTION OF THE DRAWINGS

FIG. 1 is a perspective view of the main components of a signal transfer assembly according to the present invention, including a transfer tip assembly and a transfer strip assembly, with the components being shown in service as an apparatus for remotely electro-mechanically deactuating and unlocking a locked door-locking mechanism.

FIG. 2 is a perspective view from below of the transfer strip assembly of FIG. 1.

FIG. 3 is a side view of the transfer tip assembly of FIG. 1 in combination with the door-locking mechanism.

FIG. 4 is a perspective view of a transfer tip assembly according to the present invention.

FIG. 5 is an exploded view of the transfer tip assembly of FIG. 4, showing a two-piece transfer tip housing, with dual transfer tips, transfer tip connecting wires and other components of the transfer tip assembly.

FIG. 6 is a view of another embodiment of a two-piece transfer tip assembly housing showing an alternative means of fastening the housing pieces.

FIG. 7 is a view of still another embodiment of a two-piece transfer tip assembly housing showing another alternative means of fastening the housing pieces.

DETAILED DESCRIPTION OF PREFERRED EMBODIMENTS OF THE INVENTION

A detailed description of the elements of an apparatus according to the present invention and their method of operation, for a generalized application to two mechanical components, one fixed and one moveable, will next be described. Following thereafter, a detailed description of a specific embodiment of the apparatus of the present invention for use as an electromechanical means of remotely deactuating a locked door locking mechanism is given.

It will be understood that the description of the elements, even for the general embodiment, is by way of example only, and that many variations in, for example, number, size, configuration and positioning of the elements are to be considered within the scope of the present invention.

General Embodiment of the Apparatus

The present invention provides an apparatus in an electromechanical system for transferring an electrical signal from a remotely actuated control device of the system to a mechanical fastener of the system that holds a first, moveable mechanical component of the system in a fixed position with respect to a second, fixed mechanical component of the system, in order to remotely electromechanically deactuate the mechanical fastener, thereby releasing the first moveable mechanical component of the system for movement with respect to the second, fixed mechanical component of the system.

Generally, an electromechanical system in which the apparatus of the present invention is utilized includes a first mechanical component that is fixed; a second, moveable mechanical component that cooperates with the first mechanical component such that the second mechanical component is fixedly maintained with respect to the first mechanical component in at least one first relative position between the first mechanical component and the second mechanical component; and further such that the second mechanical component is movable to at least one other second relative position with respect to the first mechanical component. The first and second mechanical components are held in the at least one first relative position with respect to one another by an electro-mechanically deactuatable mechanical fastener, the mechanical fastener being capable of assuming a first, engaged position for maintaining the second component in fixed relationship to the first component while the first component and the second component are in one of the at least one first relative positions between the first component and the second component, when the mechanical fastener is actuated. The mechanical fastener is also capable of assuming a second, disengaged position wherein the second component is capable of assuming one of its at least one second positions wherein it is movable with respect to the first component, when the mechanical fastener is deactuated.

The overall system in which the apparatus of the present invention is utilized also includes a control device, which is connected to an electrical supply source, and which is used for electro-mechanically deactuating the mechanical fastener. The apparatus of the present invention, utilized in such a system, is a transfer apparatus for transferring an electrical signal from the control device to the mechanical fastener in order to remotely electromechanically deactuate the mechanical fastener, thereby releasing the first and second components of the mechanical system with respect to one another.

The transfer apparatus of the present invention generally includes a transfer tip assembly and a transfer strip assembly.

The transfer tip assembly includes a housing, with an interior having an inner volume and an exterior having a perimeter and an outer surface. The housing is typically formed in a plurality of pieces, which, alternatively, are capable of being detachably attached to one another or permanently attached or affixed to one another, to form the complete housing. The complete housing typically is an enclosed, three-dimensional, six-sided figure that has a cubic shape, with six identical square side surfaces, or has a parallelepiped shape, wherein all six side surfaces are rectangular or a combination of rectangular and square shaped.

Most typically, the housing is formed in two pieces. According to certain embodiments, the two pieces of the housing can each represent substantially one-half of the entire housing, with each half occupying about one-half of the total overall volume of the complete housing, and with each half having about one-half of the total surface area of the complete housing. According to other embodiments, one piece of the housing can encompass substantially the entire volume of the complete housing and have a surface area that is approximately ⅚ of the total surface area of the complete housing (i.e., for a cubic shaped housing; the proportion is somewhat different for a parallepiped shaped housing where all six side surfaces do not have identical areas); and the other piece of the housing is substantially a flat cover plate for the first piece, that has a surface area that is approximately ⅙ of the total surface area of the complete housing.

The inner volume of the housing has a plurality of compartments therein. Some of these compartments are enclosed, sectioned-off volumes of the housing that are formed by internal reinforcing walls within the housing or the individual pieces thereof. There is, however, also an even number of at least two open-ended transfer tip channels or open compartments that are elongated in shape, extend the entire length of the housing, from a top end thereof to a bottom end thereof, and are spaced apart from one another. Each such transfer tip channel or compartment has an opening therein at opposite ends of the housing at an exterior edge of the housing. The channels have a width and depth sufficient for each channel to accommodate an electrically conductive member referred to as a transfer tip. Where the housing is formed from two equal half-pieces, each half of the housing has one-half of each of the transfer tip channels formed therein extending inwardly into that piece of the housing from an edge of that piece of the housing that communicates with the opposite half of the housing so that when assembled, the two halves of the housing form the complete transfer tip channels.

Alternatively, a multi-part housing, particularly one having two pieces, can be formed such that substantially all of the volume of the housing and the complete transfer tip channels and openings therefor are within a first piece of the housing and the second piece of the housing is substantially a flat cover plate that is attachable to the first piece.

The several pieces of a multi-part housing are attachable to one another in a number of alternative ways. It is generally desirable that the pieces of the housing be detachably attached to one another so that after assembly they can subsequently be taken apart again if necessary to repair or replace broken or damaged internal components. Accordingly, the pieces of a transfer tip housing can be assembled using at least one, or preferably a plurality of screws. Appropriate holes are formed in at least one piece of the housing through which the screws are inserted.

Where the housing pieces are formed of a molded plastic material, one or more pieces of a multi-part housing can have threaded screw receptacles formed directly therein to hold a screw inserted through a first piece and passing therethrough and into a second piece bearing the threaded receptacle to hold the pieces together. Alternatively, holes may be formed in corresponding pieces and a screw passed through both pieces and secured with a separate nut. Appropriate recesses may be formed in the exterior surface of the housing pieces so that screw heads and/or nuts fit flush or are recessed within the exterior surface of the housing.

Alternatively, the pieces of a multi-part housing can be attached to one another using any type of snap-together interlocking tongue and groove or snap and groove system. In a tongue and groove system, a groove may extend around the entire perimeter of an inner edge of a first piece of the housing and a corresponding cooperating interlocking tongue extends around the entire perimeter of an inner facing edge of the second piece, so that when the two pieces are assembled, the tongue of the one piece cooperatively engages with and interlocks with the groove of the other piece to hold the housing assembly together.

In a snap and groove system, a plurality of separate snaps are formed around the perimeter of an inner edge of one piece of the housing, instead of a continuous tongue; and a corresponding plurality of catches are formed on the corresponding inner facing edge of the other piece. For a two-piece square or rectangular shaped housing, at least one snap and corresponding catch should be formed on at least two opposite side edges of the housing pieces. Preferably, at least one snap and corresponding catch is formed on each of the four edges of each piece of the housing. For large housings, it may be desirable or necessary to have multiple snaps and catches on each of the four edges to securely hold the two housing pieces together.

For any of the above types of fasteners, tongue and groove or snap and catch, screws can additionally be used, as described above, to further securely hold the housing pieces together.

In yet still another embodiment, the two pieces of a two-piece square or rectangular housing can be hinged along one edge so as to form a single piece, with at least one snap and catch fastener being provided along at least one other of the edges of the pieces, and/or at least one screw passing through the pieces, being utilized to hold the hinged pieces together when the transfer tip assembly housing is in its assembled, closed condition.

According to still other embodiments of the apparatus of the invention, the pieces of a multi-piece transfer tip assembly housing can be permanently assembled to one another such as by gluing or fusing the pieces together, particularly when the pieces of the housing are formed from a plastic material. An apparatus having such a permanently sealed housing for the transfer tip assembly may be easier and cheaper to assemble initially, but it has a disadvantage in that once assembled it cannot be opened to access the internal components for repair or replacement if they should become damaged or inoperative, and the entire transfer tip assembly would have to be replaced in such a situation. A permanently sealed transfer tip assembly housing has an advantage in that it is more resistant to moisture entering into the housing which could cause an electrical short circuit or eventually corrode other internal components of the transfer tip assembly.

In order to prevent or minimize the likelihood of moisture entering into a multi-piece transfer tip assembly housing that is not permanently assembled and substantially sealed against moisture, particularly for outdoor services where the transfer tip assembly may be exposed to moisture from rain or snow, it is desirable that the above-described tongue and groove configuration extending around the perimeter of the entire internal edge be utilized, either alone or in combination with screws to make the transfer tip assembly more moisture-proof or fluid-tight, or that alternatively, a sealing gasket be provided around the inner edge where the pieces of the housing are joined.

The transfer tip assembly housing is made to be fixedly attachable to the second mechanical component of the mechanical system. The housing and the individual pieces thereof in the case of a multi-piece housing is preferably made from an electrically non-conductive material, such as a plastic. Some plastics that may be used for fabricating the housing include polyamide, polycarbonate, nylon, polypropylene, and polystyrene. Polyamide is preferred. Alternatively, the housing can be made from a metal, as long as all interior components are electrically insulated from the housing itself. A metal housing can be made from steel, stainless steel, or aluminum. A plastic or rubber lining is placed or coated on the interior of a metal housing in order to electrically insulate it from the interior components, including a plurality of transfer tips.

The transfer tip assembly includes a plurality of transfer tips which are contained substantially within the housing in the corresponding transfer tip channels, with there being one transfer tip in each transfer tip channel. The transfer tips are flexibly mounted within the channels such that they are each individually capable of assuming a first default position wherein at least a part of each transfer tip extends outside of the housing, due to a biasing means maintaining each transfer tip in that position; a second position wherein the entire transfer tip is inside the housing; and a plurality of intermediate positions therebetween wherein due to a force counteracting the biasing means, only a portion of each transfer tip, less than the amount which extends outside the housing in the default first position, remains extending outside the housing through the openings therein for the transfer tips.

The transfer tip assembly is provided with an even-numbered plurality of individual transfer tips. There is a corresponding number of transfer tips and transfer tip channels in the housing. A transfer tip is advantageously a thin flat rectangular shaped plate element, having a first end that extends outside of the housing when the transfer tip is in the first, default position in its channel, and a second end that remains within the housing as the transfer tip moves between its first and second positions and intermediate positions therebetween.

The transfer tips have a length, a width, and a thickness, such that the width is greater than the thickness, and the length is greater than the width. The length of each transfer tip does not exceed the length of its channel in the housing; the width of each transfer tip does not exceed and is slightly less than the width of its channel and the opening in the housing for that transfer tip; and the thickness of each transfer tip does not exceed and is slightly less than the thickness of its channel and the opening in the housing for that transfer tip, so as to enable each transfer tip to slide in its channel and at least partly outside of the housing to its first, default position, without being impaired by the channel or channel opening in the housing.

Each transfer tip further has a proximal end which remains disposed within its transfer tip channel in the housing and with each transfer tip also having a distal end which is capable of extending outside of its transfer tip compartment in the housing and beyond the perimeter of the housing.

Each transfer tip is biased by transfer tip biasing means for that transfer tip, which biasing means causes the transfer tip to assume a first default position wherein at least a portion of that transfer tip, including its distal end, extends at least partly outside of its respective transfer tip channel through the opening in the housing at the end of the channel proximate to that transfer tip's distal end, and beyond the perimeter of the housing, in the absence of a force exerted on the transfer tip urging the transfer tip to retract into the housing. Each transfer tip further assumes a second position wherein it is advantageously fully retracted into its respective channel in the housing, within the perimeter of the housing, when a sufficient force is exerted on it to overcome the resistive force of the transfer tip biasing means for that transfer tip.

Each transfer tip is also capable of assuming a plurality of positions between the first and second positions, wherein at least a part of that transfer tip, including its distal end, extends a distance out of its transfer tip channel. The distance which the transfer tip extends is proportional to a force exerted on that transfer tip in opposition to the resistive biasing force of that transfer tip's transfer tip biasing means.

Each transfer tip is independently slidably movable within its channel such that in the default first condition at least one end thereof extends at least partly outside of its channel beyond the perimeter of the housing. In any given transfer tip assembly, there are advantageously an even number of transfer tips in order to provide a complete electrical circuit. There must be at least two transfer tips, although a greater even number can be utilized, with additional even multiples of transfer tips being electrically connected in parallel to the corresponding first transfer tip of each multiple. A transfer tip assembly can have between 2 and about 12 transfer tips. The number of transfer tips is determined in part by the size of the mechanical components whose operation is controlled by the transfer tip device. Accordingly, a transfer tip may have 2, 4, 6, 8, 10, or 12 transfer tips. Although a transfer tip assembly can be constructed with any even number of transfer tips beyond 12, the electrical connections for such arrangements tend to become cumbersome and unwieldy.

In any transfer tip assembly, all of the individual transfer tips are typically identical in size and shape. The end of each transfer tip that is capable of extending beyond the perimeter of the housing when in the first default condition preferably has a semi-circular or similarly rounded end so as to enable smooth movement with respect to a corresponding transfer strip when the two mechanical components that are operated and controlled by the device, with the transfer tip assembly being mounted on one mechanical component and the cooperating transfer strip assembly being mounted on the other mechanical component, are moved with respect to one another, so as to prevent the movement of the two mechanical components from being hindered due to the transfer tips binding, sticking or catching with respect to transfer strips with which they cooperate.

According to one embodiment, the transfer tip biasing means are springs. The springs can be coil or leaf springs.

In one embodiment utilizing coil springs, each transfer tip has a slot or opening in its surface running axially along a portion of the length of the transfer tip between is proximal and distal ends. A coil spring is inserted in the slot in each transfer tip. A cross-bar member is also inserted in each slot between a lower edge of the slot nearest to the proximal end of the transfer tip that remains inside the housing. The cross member is perpendicular to the longitudinal axis of the transfer tip and the spring in the slot in the transfer tip. A recess is formed in the housing on either side of the channel for the transfer tip in which the cross member rests. This provides a resistance against which the spring is compressed when the transfer tip is pressed axially downward into the channel to retract it into the housing, and which causes the spring to return the transfer tip to its default condition wherein it extends at least partially outside the housing when the external compressive forces acting to urge the transfer tip into its retracted position inside the housing are removed.

As will be evident to persons of ordinary skill in the art, alternative means for biasing the transfer tip can be utilized to the same effect as the above described embodiment. Such alternative embodiments may utilize different types of springs, such as leaf springs, for example, or may utilize still other completely different mechanical means to produce the same or an equivalent result of biasing the transfer tips.

The transfer tips are made of an electrically conductive material, generally a metal. Some metals that can be used for the transfer tips typically include stainless steel, aluminum, silver, copper, gold, alloys containing at least one of the above, and combinations thereof. Where the transfer tips are utilized in an environment in which they may see outdoor service or otherwise be exposed to moisture or the elements, it is desirable that they be fabricated from a non-rusting, corrosion-resistant material, such as stainless steel.

There are a plurality of electrically conductive transfer tip wires, corresponding in number to the number of transfer tips. Each electrically conductive transfer tip wire is attached at one end thereof to the proximal end of its respective corresponding transfer tip and extends therefrom through an opening in the housing leading to the transfer tip compartment for that transfer tip, with the opening being proximate to the proximal end of that transfer tip. An opposite end of each transfer tip wire is connected to the electromechanically actuatable mechanical fastener. The transfer tip wires can be attached to the proximal ends of their respective transfer tips through anchoring holes in the proximal ends of the transfer tips, which can then be permanently soldered, or the transfer tip wires can just be soldered to the proximal ends of the transfer tips without the use of anchoring attachment holes in the tips.

The individual transfer tip wires leading out of the bottom of the housing can be bundled and attached to a harness which can be attached and anchored to the housing by a screw or other means to reduce tensile strain on the wires which may cause them to be detached from or break away from their respective transfer tips causing a break in electrical contact and electrical failure of the apparatus.

The transfer strip assembly includes an even-numbered plurality of transfer strips, such that the number of transfer strips corresponds in number to the number of transfer tips. The transfer strips having a flat planar configuration, with a length, a width, and a thickness, and have opposite first and second surfaces. The transfer strips are made from an electrically conductive material, usually a metal. The transfer strips are typically made from the same material as the transfer tips. Some metals that can be used to fabricate the transfer strips include: stainless steel, aluminum, silver, copper, gold, alloys containing at least one of the above, and combinations thereof. As with the transfer tips, where the transfer strips are utilized in an environment in which they may see outdoor service or otherwise be exposed to moisture or the elements, it is desirable that they be fabricated from a non-rusting, corrosion-resistant material, such as stainless steel.

The transfer strips are attached to a transfer strip mounting plate. Generally, the transfer strips are permanently, fixedly mounted on the transfer strip mounting plate. The transfer strip mounting plate has a first exterior-facing surface and a second, interior-facing surface. The transfer strip mounting plate is for attachment to the first mechanical component of the mechanical system. The individual transfer strips are mounted on the transfer strip mounting plate such that a first surface of each transfer strip faces toward the exterior-facing side of the transfer strip mounting plate, and a second surface of each transfer strip faces toward the interior-facing side of the transfer strip mounting plate.

The transfer strips can be attached to the transfer strip mounting plate in a number of ways, including by the use of mechanical attachment means or by the use of an adhesive or glue. According to certain embodiments that utilize mechanical attachment means, the means are a plurality of finger-like elements or claws that are formed integrally with each strip and extend outwardly from each side and/or end of each strip. There should be at least one finger on each side of each strip. Depending on the length of the strips, there may be more than one finger one each side. Although there is no limitation on the number of fingers on each side of a transfer strip, typically there is two or three for medium-length strips and from about three to about six for longer strips. Additionally, depending on the width of each strip, a finger may be attached to each end of the strip. For very narrow strips, it is usually unnecessary to have a finger on the ends of the strips. For medium width strips, generally a single finger at each end is sufficient; and for wide strips, there may be two or three fingers at each end of the strip in addition to the side fingers.

The fingers cooperate with correspondingly spaced holes in the transfer strip mounting plate. The fingers are bent perpendicularly to the transfer strip and the fingers inserted through the corresponding holes in the transfer strip mounting plate, whereupon they are again bent at substantially right angles into the plane of the transfer strip mounting plate to hold the strips in place. The transfer strip mounting plate typically has a plurality of recesses or a single large in its surface on which the transfer strips are attached so that each strip fits flush with the remaining surrounding surface of the transfer strip mounting plate. The transfer strips are spaced apart from one another on the transfer strip mounting plate at distances corresponding to the spacing of the corresponding transfer tips in the transfer tip assembly housing.

The transfer strip mounting plate is made from an electrically non-conductive material; such as a plastic. Some plastics that can be utilized for fabricating the transfer strip mounting plate include polyamide, polycarbonate, nylon, polypropylene, and polystyrene. Polyamide is a preferred plastic material for fabricating the transfer strip mounting plate. Although they need not be fabricated from the same material, generally, the transfer strip mounting plate and transfer tip assembly housing, as well as any other components of the device that are fabricated from an electrically non-conductive material are all made from the same material in any given device.

The transfer strip mounting plate is fixedly attachable to the first mechanical component of the mechanical system, with the interior-facing surface of the transfer strip mounting plate facing towards the first mechanical component. The transfer strip mounting plate is attached to the first mechanical component by any standard fixations technique, such as by using mechanical fasteners or by using a glue or adhesive. Mechanical fasteners include screws and nails. The choice of fastening technique and means is determined in part by the nature of the materials of the transfer strip mounting plate itself and the first mechanical component to which the transfer strip mounting plate is to be attached. Thus, for example, by choice of the appropriate type of screw (e.g., metal screw or wood screw), screws can be utilized for substantially any transfer strip mounting plate and first mechanical component materials. A glue or adhesive can be utilized if permanent, non-removable installation is desired.

According to one embodiment, the transfer strip mounting plate includes a side panel for more securely attaching the transfer strip mounting plate to the fixed mechanical component of the system having an element with an angle, such as a right angle of a member of a door frame. The side panel is a surface that is appended to the main transfer strip mounting plate. Where the transfer strip mounting plate is made from a flexible plastic material, the side panel can be made as an integral part of the transfer strip mounting plate and is flexibly hinged along an edge of the transfer strip mounting plate by a plurality of individual self-hinges or a single continuous self-hinge of the same plastic material as the main transfer strip mounting plate and the side panel.

According to one embodiment, the side panel is hinged along an edge of the transfer strip mounting plate that is perpendicular to the longitudinal axis of the transfer strips mounted on the transfer strip mounting plate. The side panel has means for enabling its attachment to a surface of the first, fixed mechanical component of the system at an angle to the transfer strip mounting plate itself. The side panel can be configured to whatever angle is necessary by bending it along the hinged edge to conform to the angle of the fixed component to which it is to be mounted.

Alternatively, the side panel can be a separate piece that is attached to the main transfer strip mounting plate.

For example, where the transfer strip mounting plate is made from a material other than a flexible plastic, the side panel can be made as a separate piece that is attached to the main transfer strip mounting plate. Attachment can be by any means such as by a hinge, or the side panel can be permanently attached to the main transfer strip mounting plate at any angle with respect thereto as is required to mount the transfer strip mounting plate and the side panel on the particular fixed mechanical component of the system on which the apparatus is being installed.

Typically, the side panel has at least one or a plurality of holes extending perpendicularly through the surface of the side panel, through which one or more screws can be driven to attach the side panel to the surface of the fixed mechanical component. Alternatively, depending in part on the nature of the surface of the fixed mechanical component to which the transfer strip mounting plate and side panel are being mounted, an inner surface of the side panel can be provided with a adhesive surface, as the transfer strip mounting plate itself. Alternatively, the side panel and/or transfer strip mounting plate can be permanently glued to a surface of the fixed component of the mechanical system.

Where the side panel is a separate piece attached to the main transfer strip mounting plate, made from a material other than a flexible plastic, and is made from a metal, the side panel must be electrically insulated from the transfer strips on the transfer strip mounting plate.

Where it is not necessary to utilize the side panel, such as where there is only a flat surface to which the transfer strip mounting plate is to be attached, the side panel can be dispensed with. In the case of a separate side panel, the side panel is simply not attached to the main transfer strip mounting plate. In the case of a side panel integrally formed with the transfer strip mounting plate from a flexible material, the side panel can simply and conveniently detached along its hinged edge by cutting or breaking the hinge(s).

When the first and second mechanical components of the mechanical system are in one of the at least one first relative positions between the first component and the second component, wherein the second mechanical component is fixedly maintained with respect to the first mechanical component, each of the transfer tips is in electrical contact with its corresponding transfer strip.

There are a plurality of electrically conductive transfer strip wires, corresponding in number to the number of transfer strips, with each electrically conductive transfer strip wire being attached at one end thereof to the second, interior-facing surface of its respective corresponding transfer strip and extending therefrom through an opening in the interior-facing surface of the transfer strip mounting plate. An opposite end of each transfer tip wire is connected to the control device.

The interior facing surface of the transfer strip mounting plate, which is in proximate contact with the first mechanical component of the mechanical system can also have a covering material to protect the connections of the transfer strip wires to the transfer strips. The covering material should be electrically non-conductive and is typically made from plastic or plastic or wax-covered cardboard. The covering material is typically attached to the interior-facing surface of the transfer strip mounting plate by a glue or adhesive.

When the mechanical fastener is engaged, the second mechanical component of the mechanical system is maintained in one of the at least one first positions relative to the first mechanical component of the mechanical system, wherein the first and second components are fixed with respect to one another, with each of the transfer tips in the transfer tip assembly mounted on the second mechanical component of the mechanical system being in electrical contact with its corresponding transfer strip of the transfer strip assembly, mounted on the first mechanical component of the mechanical system.

When the control device is actuated, an electrical signal first passes through the transfer strip wires to the transfer strips, then through the transfer tips, and finally through the transfer tip wires to the mechanical fastener, which is thereby electro-mechanically disengaged, such that the second mechanical component of the mechanical system is then made movable with respect to the first mechanical component of the mechanical system to one of the second relative positions between the first and second mechanical components of the mechanical system, wherein the transfer tips and the transfer strips are no longer in electrical or physical contact.

Remotely Controlled Door Lock Deactuating and Unlocking Apparatus

Although the apparatus of the present invention is utilizable in a wide variety of services requiring the remote actuation of a latched or locked mechanism, to unlatch or unlock it, and generally having a fixed component and a moveable component, it will be described in detail in the following with reference to the attached Figures illustrating a door system having a door frame as the first, fixed component and a hinged door, capable of swinging in either direction with reference to the door frame, as the second, moveable component, and having a latching or locking mechanism capable of holding the door in a closed position when actuated and enabling the door to be manually or automatically (using other apparatus) opened when in a deactuated state.

The following specific examples of an apparatus according to the present invention, including alternative embodiments thereof, are presented in the context of an apparatus for remotely electro-mechanically opening a locked door, especially a door of the type having at least a partial hollow tubular outer frame portion enclosing at least one solid door panel. Included in this type of door are doors with hollow tubular outer metal frames at at least an inner vertical hinged edge of the door, doors also having a hollow metal tubular frame element at one or both of the upper and lower horizontal edges, doors having a hollow metal tubular frame element around all four door edges, wherein the hollow metal tubular frame surrounds at least one solid glass interior panel, and doors that are divided into multiple panels by one or more horizontal and/or vertical tubular metal frame element separators, and a corresponding number of solid panels therebetween.

Conventionally, an overall door system usable with the present invention generally includes an electro-mechanically actuated door lock release mechanism (DLR) for a door system, wherein a locked door (D) is capable of being remotely unlocked, and wherein the system includes at least: a door frame (DF) that is fixed; a door (D) that cooperates with the door frame (DF) such that the door (D) is fixedly maintained with respect to the door frame (DF) in a first relative closed position between the door frame (DF) and the door (D); and further such that the door (D) is movable to at least one other second open relative position with respect to the door frame (DF); an electro-mechanically deactuatable door locking mechanism (DL), the door locking mechanism (DL) being capable of assuming a first, locked position for maintaining the door (D) in a fixed, engaged, locked relationship with respect to the door frame (DF) while the door locking mechanism (DL) is actuated to lock the door (D); and the door locking mechanism (DL) being capable of assuming a second, unlocked position wherein the door (D) is capable of assuming one of its at least one second, open, disengaged, unlocked positions wherein it is movable with respect to the door frame (DF), when the door locking mechanism (DL) is deactuated to its second, unlocked position; and a remote control device (RCD), connected to an electrical supply source, for electro-mechanically deactuating the door locking mechanism (DL).

As shown in FIG. 1, in accordance with the present invention a transfer apparatus 100 is provided for transferring an electrical (control) signal from the remote control device (RCD) to the door locking mechanism (DL) in order to remotely electromechanically deactuate the door locking mechanism (DL), thereby releasing the door (D) and door frame (DF) of the door system with respect to one another.

In such a system, the door locking mechanism, also sometimes referred to as the door trim, typically includes a solenoid that is actuated by the remote control device, such as a switch or pushbutton, that transmits an electrical signal, such as a current, or electrical power. In accordance with the present invention, this signal is transmitted through the transfer assembly apparatus 100 of the present invention, and in turn to the solenoid which when actuated causes the electro-mechanical door locking mechanism to become deactuated, thereby releasing the latch or lock mechanism to enable the previously locked door to be opened. The unlatched or unlocked door can then be opened manually, or by an automatic door opening device which can also be utilized in combination with the transfer assembly apparatus of the present invention in the overall system.

The solenoid utilized for deactuating the electro-mechanical door locking mechanism for a system of this type typically operates at a voltage of from about 12 to about 24 volts. Most frequently, the remotely controlled electro-mechanical door locking system in which the signal transfer apparatus 100 of the present invention is employed operates as an alternating current (AC) system, although the transfer assembly apparatus of the present invention can also be utilized in a direct current (DC) powered system.

According to an embodiment of the present invention, the transfer assembly apparatus 100 for a remotely controlled electro-mechanical door lock system, for transferring an electrical signal or electrical power from a remote control device (not illustrated) to an electro-mechanical door locking mechanism in order to unlock the door 400 and enable its movement with respect to a fixed door frame 500, includes two main components, namely, a transfer tip assembly 200 mounted on the door 400 and a transfer strip assembly 300 mounted on the door frame 500.

As shown best in FIGS. 4–7, the transfer tip assembly 200 includes a housing 201, which is typically formed in a plurality of pieces. Most typically, the housing 201 is fabricated in two pieces 201*a*, 201*b*. According to these embodiments, the two pieces are mirror-image halves, or are at least substantially similar pieces, as to their dimensions and construction, which cooperate with one another and can be tightly and securely attached to one another and assembled to form the complete housing 201. In such an embodiment, the two halves 201*a*, 201*b* are attached to one another using common fastening means, such as screws and nuts. At least one, and preferably a plurality, of screws and cooperating nuts are used to secure the two pieces of the housing together. Most typically two screws and nuts are used. In such an embodiment utilizing screws and nuts to secure the pieces of the housing together, each half or piece of the housing has a hole extending through the piece for each screw that is used to secure the pieces together. For the most typical embodiment utilizing two screws and nuts shown in FIGS. 4 and 5, each piece 201*a*, 201*b* has a pair of holes 204*a*, 204*b*, 204*c*, 204*d* extending therethrough, from front to back (between an outer edge surface and an inner peripheral edge of the piece) with the two holes in each piece of the housing aligning with the corresponding pair of holes in the cooperating piece of the housing, to accommodate fastening the two halves of the housing together with a pair of screws 202*a*, 202*b* and corresponding nuts 203 (not illustrated). Preferably, the screw heads and nuts are recessed within the body of the housing when assembled.

Alternatively, as shown in FIG. 6, the pieces 221*a*, 221*b* of a multi-piece housing 221 can be provided with an interlocking flange and groove type system, or equivalent snap-tight engaging system, to hold the pieces together. In such a system, for a two-piece housing as described above for the screw and nut fasteners example of FIGS. 4 and 5, one piece 221*a* of the housing is provided with a plurality of notches 222*a*, 222*b* or a grooved portion around at least a portion of an inwardly facing peripheral edge 223 of the piece 221*a* (i.e., the edge of the piece 221*a* that faces toward and cooperates with the inner edge of the other cooperating housing piece 221*b*) and the other piece 221*b* of the housing is provided with a flanged portion around at least a portion of its inner peripheral edge that cooperates with and engages the inner peripheral edge of the other piece 221*a*, such that the flanged and grooved portions engage with one another to hold the two pieces together.

As shown in FIG. 6, the flanged portion includes flanges 224*a*, 224*b* that respectively engage the notches 222*a*, 222*b*. The pieces 221*a*, 221*b* are then held in position by a screw and nut (not illustrated) used to mount the housing 221 in the door 400 and passing through a hole 225 through the two pieces 221*a*, 221*b*.

According to still other embodiments, as shown in FIG. 7, the housing 251 can be made of two pieces 251*a*, 251*b* that are hinged together along at least one common inner edge 252 of their periphery, with the pieces 251*a*, 251*b* being held together with a screw and corresponding nut (not illustrated) mounting the housing 251 in the door 400 and passing through a hole 253 in the two pieces at or near their center or near an opposite edge to the hinged edge. Alternatively, there may be one or more snap together flanges and grooves or notches along an opposite edge or one or more adjacent and opposite edges to the hinged edge, with the flanges being on one piece of the housing and the cooperating grooves or notches being on the other piece of the housing.

By whatever manner the pieces of a two- or multi-piece housing are attached to one another, either using screws and nuts, a groove and interlocking flange system, or other means that provide substantially equivalent secure attachment between the housing pieces, it is generally desirable that the two or more pieces be detachably and not permanently attached to one another, so that they can be separated if necessary to access the inner components of the transfer tip assembly, such as for repair purposes.

Alternatively, however, in other embodiments, the transfer tip assembly 200 can be fabricated and assembled as a permanently assembled unit, wherein the pieces of the housing are permanently attached to one another when the unit is assembled, and such that later access to the inner components of the transfer tip is thereby prevented. In such a case, the pieces of the housing may be glued, fused, welded, or otherwise permanently attached together in an appropriate manner depending upon the nature of the material from which the housing pieces are fabricated. In such an embodiment, where the housing pieces are permanently attached together and wherein access to the inner components thereof is prevented, the transfer tip assembly 200 is considered to be disposable rather than repairable, and the entire transfer tip assembly 200 is replaced in the event of failure of any of its internal components, rather than repairing it by opening the housing to repair or replace any damaged or broken internal components.

Referring back to FIGS. 4 and 5, the housing 201, overall, has an interior 205 with an inner volume and an exterior with a perimeter and an outer surface including an upper first surface 209*a* and a lower second surface 209*b*. For a two-piece housing, each piece, or half, where the two pieces are substantially identical, of the housing has a proportional volume, surface and dimensions to the overall, assembled housing. Thus, where the two pieces are substantially identical halves, each piece occupies half of the total volume and surface area as the fully assembled housing.

Alternatively, the housing may be formed in two parts wherein one part encompasses substantially the entire volume of the fully assembled housing, and, in the case of a substantially cubic or rectangular parallelepiped shaped housing, incorporates an outer surface area equivalent to that of five of the six sides of the shape, with the second part of the housing being substantially a flat cover plate for the sixth side of the shape, which is, preferably, detachably attached, or, alternatively, is permanently attached to the other piece, by any of the respective means described hereinabove for other multi-piece housings.

It will be apparent to a person of ordinary skill in the art that yet other configurations of the housing, which are within the scope of this invention, are possible. From a purely technical viewpoint, there is virtually an unlimited number of ways in which the housing can be fabricated. From an economical viewpoint, however, it is desirable to construct the housing as simply as possible, in as few pieces as possible.

The housing is generally made from a plastic material. Plastics such as polyamide, polycarbonate, nylon, polypropylene and polystyrene can be utilized. Polyamide is a preferred plastic material for the housing. The housing is desirably non-electrically conductive, and should be strong and resistive to cracking and/or breakage. Because the housing is typically molded, it is desirable that the plastic material utilized for the housing be one that is easily molded, such as by standard injection molding techniques.

Alternatively, however, the housing can be made from a metal, such as aluminum or steel. Metal housing pieces can be made by stamping, molding, or die-casting techniques. Where housing pieces for the transfer tip assembly housing are made from metal, it is, however, essential that the inner housing be made electrically non-conductive in order to electrically insulate the inner housing surface and volume from the components mounted therein. The inner surface of a metal housing piece can be made electrically non-conductive by coating or lining it with a plastic or rubber material.

Referring now to the overall housing, keeping in mind that in the case of a multi- or symmetrical two-part housing each part will be configured identically or similarly and will be of proportional or half the volume and surface of the total; and in the case of a multi- or two-part housing wherein one part encompasses substantially the entire volume of the entire housing and approximately ⅚ of the outer surface area, with the second piece being substantially a flat cover plate for the other piece, with a surface area about ⅙ of the total of the housing, the inner volume of the housing is divided into a number of compartments and has a number of passageways or channels running therethrough. This is illustrated most clearly in FIGS. 5 and 6.

In each embodiment, the housing has a plurality of at least two channels that extend fully therethrough, ending in slotted openings at opposite ends of the housing. In FIG. 5, there are channels 210*a*, 210*b*, and in FIG. 6 there are channels 226*a*, 226*b*. These open ended channels constitute transfer tip mounting channels or compartments.

References in the following will be made to the embodiment of FIG. 5, although corresponding structure is found in the other embodiments.

An even number, of at least two, of the elongated transfer tip channels 210*a*, 210*b* are spaced apart from one another, and each such transfer tip channel has a plurality of openings therein leading to the exterior of the housing 201, such that there are a pair of openings 211*a*, 211*b* in first surface 209*a* at the top of the housing 201 and a corresponding pair of openings 212*a*, 212*b* in the second surface 209*b* at the bottom of the housing at opposite ends to one another and there are at least two such pairs of opposite openings. The housing 201 is adjustably fixedly positionable on the door 400 of the door system. The housing is made from an electrically non-conductive material.

The transfer tip assembly further 200 includes an even-numbered plurality of transfer tips 213*a*, 213*b*, corresponding in number to the number of transfer tip channels 210*a*, 210*b*, with each transfer tip 213*a*, 213*b* being independently slidably movable, advantageously entirely within, and at least partly outside of, its respective transfer tip channel 210. The transfer tips 213 are made of an electrically conductive material, and advantageously have a flat elongate shape, with a length, a width and a thickness, such that the width is greater than the thickness, and the length is greater than the width. Each transfer tip 213*a*, 213*b* further has a proximal end 214*a*, 214*b* which remains disposed within its transfer tip channel 210*a*, 210*b*. Each transfer tip 213*a*, 213*b* also has a distal end 215*a*, 215*b* which is capable of extending outside of its transfer tip channel 210*a*, 210*b* and beyond the perimeter of the housing 201, i.e. through the first surface 209*a* of the housing.

Each transfer tip 213*a*, 213*b* is biased by respective transfer tip biasing means 216*a*, 216*b* for that transfer tip, for example, the leaf or coil spring described above. Each biasing means causes its respective transfer tip to assume a first default position wherein at least a portion of that transfer tip, including its distal end, extends at least partly outside of its respective transfer tip channel through the opening in the housing for that channel proximate to that transfer tip's distal end, and beyond the perimeter of the housing, in the absence of a force exerted on the transfer tip urging the transfer tip to retract into the housing. Each biasing means further acts such that each transfer tip assumes a second position wherein it is fully retracted into its respective channel, within the perimeter of the housing, when a sufficient force is exerted on it to overcome a resistive force of the transfer tip biasing means for that transfer tip. Each biasing means acts still further such that each transfer tip is capable of assuming a plurality of positions between the first and second positions, wherein at least a part of that transfer tip, including its distal end, extends a distance out of its transfer tip channel, the distance being proportional to a force exerted on that transfer tip in opposition to the resistive biasing force of that transfer tip's transfer tip biasing means.

There are a plurality of electrically conductive transfer tip wires 217*a*, 217*b*, corresponding in number to the number of transfer tips 213*a*, 213*b*. Each electrically conductive transfer tip wire 217*a*, 217*b* is attached at one end 218*a*, 218*b* thereof to the proximal end 214*a*, 214*b* of its respective corresponding transfer tip 213*a*, 213*b* and extends therefrom through the opening in the housing 201 proximate to the proximal end of that transfer tip leading to the transfer tip channel for that transfer tip. As shown in FIG. 3, an opposite end 219*a*, 219*b* of each transfer tip wire 217*a*, 217*b* is connected to the electromechanically actuatable door locking mechanism 600.

FIG. 3 and also illustrate that the housing 201 is advantageously mounted in the door 400 using a screw 230 threaded through a hole 231 in the housing 201.

The signal transfer apparatus 100 of the present invention further includes a transfer strip assembly 300 which, as shown in FIG. 2, includes an even-numbered plurality of transfer strips 301. FIG. 2 is a view of the door frame 500 viewed from below with an L-shaped transfer strip assembly

300 mounted on the bottom surface 501 of the top door jamb 502 and mounted on a vertical side surface 503 of the jamb 502. The number of transfer strips 301 corresponds in number to the number of transfer tips 213, and in this embodiment comprises two: 301*a*, 301*b*. The transfer strips 301 advantageously have a flat planar configuration, with a length, a width and a thickness, and have opposite first 305 and second 306 surfaces (see FIG. 3). The transfer strips 301 are made from an electrically conductive material.

The transfer strips 301 are fixedly attached to a transfer strip mounting plate 310. The transfer strip mounting plate 310 advantageously has a main portion 315 and a side panel 316. The main portion 315 has a first exterior-facing surface 311 and a second, interior-facing surface 312. The transfer strip mounting plate 310 is attached to the door frame 500 of the door system.

The main portion 315 is mounted on the bottom, horizontal surface 501 of the door jamb 502, advantageously using screws 320, with the exterior-facing surface 305 facing down. The side panel 316 is mounted on the side, vertical surface 503, also using a screw 321. The L-shape of the mounting plate allows it to be more securely mounted.

The transfer strips 301*a*, 310*b* are mounted on the main portion 315 of the transfer strip mounting plate 310 such that the first surface 305 of each transfer strip 301 faces toward the exterior-facing side 311 of the transfer strip mounting plate 310, and the second surface of each transfer strip 301 faces toward the interior-facing side 312 of the transfer strip mounting plate 310, with the transfer strips 301 being spaced apart from one another on the transfer strip mounting plate 310 at distances corresponding to the spacing of the corresponding transfer tips 213. The transfer strip mounting plate 310 is made from an electrically non-conductive material.

The interior-facing surface 312 of the transfer strip mounting plate 310 is fixedly attachable to the door frame 500 of the door system such that when the door 400 and door frame 500 of the door system are in one of the at least one first relative positions between the door 400 and the door frame 500, wherein the door 400 is fixedly maintained with respect to the door frame 500, each of the transfer tips 213*a*, 213*b* is in electrical contact with its corresponding transfer strip 310*a*, 310*b*.

As shown in FIG. 3, a plurality of electrically conductive transfer strip wires 313, corresponding in number to the number of transfer strips, are respectively connected to the transfer strips 301, with each electrically conductive transfer strip wire 313*a*, 313*b* being attached at one end 314*a*, 314*b* thereof to the second, interior-facing surface 312*a*, 312*b* of its respective corresponding transfer strip 301*a*, 301*b*. The wires 313 extend therefrom through an opening in the interior-facing surface 312 of the transfer strip mounting plate 310. An opposite end (not illustrated) of each transfer tip wire 313 is connected to receive the deactuating signal from the control device (CD).

It will be note that the remote control device (RCD) for supplying the deactuating signal includes a component physically connected to the transfer strip assembly 300 through the wires 313. The deactuating signal may be issued by actuating this component. Alternatively, the remote control device may include a further, portable component that wirelessly transmits a signal to the physically connected component to issue the deactuating signal.

Accordingly, when the door locking mechanism 600 is engaged, the door 400 is maintained in its first, locked position with respect to the door frame 500, with each of the transfer tips 213 in the transfer tip assembly 200 mounted on the door 400 being in electrical contact with its corresponding transfer strip 301 of the transfer strip assembly 300, mounted on the door frame 500. When the remote control device (RCD) is actuated, the deactuating signal first passes through the transfer strip wires 313 to the transfer strips 301, then through the transfer tips 213, and finally through the transfer tip wires 217 to the door lock mechanism 600, which is thereby electro-mechanically disengaged to unlock the door 400. The door 400 is thereby made movable with respect to the door frame 500 to one of the open positions of the door 400 relative to the door frame 500, wherein the transfer tips 213 and the transfer strips 301 are no longer in contact.

As mentioned, the number of transfer tip channels 210, transfer tips 213 and transfer strips 301 in a signal transfer apparatus is the same and ranges from 2 to about 12. In the typical apparatus, suitable for most doors, there are two of each of the above elements.

While the disclosed apparatus has been particularly shown and described with respect to the preferred embodiments, it is understood by those skilled in the art that various modifications in form and detail may be made therein without departing from the scope and spirit of the invention. Accordingly, modifications such as those suggested above, but not limited thereto are to be considered within the scope of the invention, which is to be determined by reference to the appended claims.

What is claimed is:

1. A transfer assembly apparatus for transferring an electrical deactuation signal from a signaling device to an electrically deactuable fastener mounted in a second mechanical component, the fastener having an actuated condition for maintaining the second mechanical component and a first mechanical component unmoving with respect to each other in a defined configuration and a deactuated condition for permitting the second component to move with respect to the first component, said transfer assembly apparatus comprising:

a transfer tip assembly including a housing and at least one elongated electrically-conducting transfer tip, each said transfer tip having a proximal end and a distal end and being slidably mounted in a respective channel within said housing for movement between a first position and a second position, said housing being mountable in the second component at a first surface thereof, each said transfer tip at its first position presenting its distal end through the first surface and outside of the second component by a first distance and at its second position presenting its distal end by no more than a second distance outside of the second component less than said first distance, said proximal end remaining within the respective channel in all positions of said transfer tip, each said transfer tip being normally biased to its first position, and each said transfer tip being electrically connectable to the fastener for providing the deactuation signal thereto;

a transfer strip assembly including at least one electrically conductive transfer strip;

a transfer strip mounting plate for mounting said transfer strip assembly on the first component at a second surface thereof facing the first surface of the second component such that when the first and second components are in the defined configuration and the fastener is in its actuated condition, each said transfer tip is in its first position with its distal end in electrical contact with a respective transfer strip, said mounting plate further for mounting said transfer strip assembly such that when each transfer tip is in its second position it is out of electrical contact with said transfer strip assembly; and a signal application structure for applying the deactuation signal received from the signaling device to each said transfer strip, such that when the first and second components are in the desired configuration with the fastener in its actuated condition and the signaling device issues the deactuation signal, the deactuation signal passes from each said transfer strip to each said transfer tip in electrical contact therewith and thence to the fastener to place the fastener in its deactuated condition.

2. The apparatus of claim 1, wherein said distal end of each said transfer tip in said second position is fully retracted within said housing.

3. The apparatus of claim 1, wherein said at least one transfer tip includes an even number of transfer tips and said at least one transfer strip includes the even number of transfer strips, each said transfer strip electrically contacting a respective one of said transfer tips in its first position.

4. The apparatus of claim 1, wherein each said transfer tip is biased to its first position by a spring structure.

5. The apparatus of claim 4, wherein said spring structure is a selected one of a coiled spring and a leaf spring.

6. The apparatus of claim 1, wherein said signal application structure includes a receiver for receiving the deactuation signal from the signaling device and an electrically conductive wire structure for connecting said receiver to said at least one transfer strip.

7. The apparatus of claim 6, wherein the signaling device is a remote control device and said receiver receives the deactuation signal wirelessly.

8. The apparatus of claim 6, wherein said wire structure includes a respective wire connecting said receiver to a respective one of said at least one transfer strip.

9. The apparatus of claim 1, wherein at least one of said housing and said mounting plate is made of non-conductive material.

10. The apparatus of claim 9, wherein said non-conductive material is selected from the group consisting of: polyamide, polycarbonate, nylon, polypropylene and polystyrene.

11. The apparatus of claim 9, wherein both said housing and said mounting plate are made of non-conductive material.

12. The apparatus of claim 1, wherein said transfer tips and said transfer strips are made of metal selected from the group consisting of: stainless steel, aluminum, silver, copper, gold, alloys containing at least one of the foregoing and combinations thereof.

13. The apparatus of claim 1, wherein said housing is made in two pieces and said two pieces of the housing are fastened together by means selected from the group consisting of: at least one screw that extends through a hole in one piece of said housing and is received into a threaded receptacle in the other piece of said housing, adhesive, which at least holds said two pieces of said housing together, and glue, which fuses said two pieces of said housing together.

14. The apparatus of claim 1, said mounting plate further comprising a panel that is breakaway-removably attached thereto, said panel including an attachment structure for attaching said panel to a third surface of the first component that is at a right angle to the second surface of the first component, said panel being for preventing movement of said mounting plate with respect to the first component.

15. The apparatus of claim 1, wherein when the first and second components are in the defined configuration, the second surface of the first component maintains each said transfer tip in its second position against the biasing.

16. The apparatus of claim 1, wherein the first mechanical component is a door frame and the second mechanical component is a door, said apparatus being for locking the door to the door frame when the door is closed.

17. A transfer assembly apparatus for transferring an electrical deactuation signal from a signaling device to an electrically deactuable electro-mechanical fastener mounted in a door, the fastener having a locking position for maintaining the door and a corresponding door frame unmoving with respect to each other with the door closed and an unlocked condition for permitting the door to move with respect to the door frame, said transfer assembly apparatus comprising:

a transfer tip assembly including a housing and at least one elongated electrically-conducting transfer tip, each said transfer tip having a proximal end and a distal end and being slidably mounted in a respective channel within said housing for movement between a first position and a second position, said housing being mountable in the door at a first surface of the door, each said transfer tip at its first position presenting its distal end through the first surface and outside of the door by a first distance and at its second position presenting its distal end by no more than a second distance outside of the door less than said first distance, said proximal end remaining within the respective channel in all positions of said transfer tip, each said transfer tip being normally biased to its first position, and each said transfer tip being electrically connectable to the fastener for providing the deactuation signal thereto;

a transfer strip assembly including at least one electrically conductive transfer strip;

a transfer strip mounting plate for mounting said transfer strip assembly on the door frame at a second surface thereof facing the first surface of the door such that when the door is closed and the fastener is in its locking position, each said transfer tip is in its first position with its distal end in electrical contact with a respective transfer strip, said mounting plate further mounting said transfer strip assembly such that when each transfer tip is in its second position it is out of electrical contact with said transfer strip assembly; and a signal application structure for applying the deactuation signal received from the signaling device to each said transfer strip, such that when the door is closed with the fastener in its locking position and the signaling device issues the deactuation signal, the deactuation signal passes from each said transfer strip to each said transfer tip in electrical contact therewith and thence to the fastener to place the fastener in its unlocked position.

18. The apparatus of claim 17, wherein each said transfer tip is electrically connected to the fastener by a respective wire, said transfer tip assembly being installable in a door selected from the group consisting of:

a) a solid core door having a portion of its core removed to contain said transfer tip assembly, such that said housing is positioned at an outer edge of the solid core door, and such that there is a channel in the core through which each wire extends and is connected to the fastener;

b) a hollow core door, wherein said transfer tip assembly is mounted in the hollow core such that said housing is positioned at an outer edge of the hollow core door, and such that each wire extends through the hollow core and is connected to the fastener; and c) a door fabricated from a hollow tubular door frame with at least one solid door panel therewithin, such that said housing is mounted in a portion of the tubular door frame at an outer edge of the door and such that there is a hollow portion of the tubular door frame that is proximal to the fastener through which each wire extends and is connected to the fastener.

19. The apparatus of claim 17, wherein the signaling device is a remote control device, and wherein said signal application structure includes a receiver for receiving the deactuation signal wirelessly from the remote control device and an electrically conductive wire structure for connecting said receiver to said at least one transfer strip.

20. A lockable door assembly comprising:

a door having an electrically deactuable electro-mechanical fastener mounted therein;

a door frame, said fastener having a locking position for maintaining said door and said door frame unmoving with respect to each other with said door closed and an unlocked condition for permitting said door to move with respect to said door frame; and a transfer assembly apparatus for transferring an electrical deactuation signal from a remote control device to said fastener, said transfer assembly apparatus comprising:

a transfer tip assembly including a housing and at least one elongated electrically-conducting transfer tip, each said transfer tip having a proximal end and a distal end and being slidably mounted in a respective channel within said housing for movement between a first position and a second position, said housing being mounted in said door at a first surface of said door, each said transfer tip at its first position presenting its distal end through said first surface and outside of said door by a first distance and at its second position presenting its distal end by no more than a second distance outside of said door less than said first distance, said proximal end remaining within the respective channel in all positions of said transfer tip, each said transfer tip being normally biased to its first position, and each said transfer tip being electrically connected to said fastener for providing the deactuation signal thereto;

a transfer strip assembly including at least one electrically conductive transfer strip;

a transfer strip mounting plate for mounting said transfer strip assembly on said door frame at a second surface thereof facing said first surface of said door such that when said door is closed and said fastener is in its locking position, each said transfer tip is in its first position with its distal end in electrical contact with a respective transfer strip, said mounting plate further mounting said transfer strip assembly such that when each said transfer tip is in its second position it is out of electrical contact with said transfer strip assembly; and a signal application structure for applying the deactuation signal received from the remote control device to each said transfer strip, such that when said door is closed with said fastener in its locking position and the remote control device issues the deactuation signal, the deactuation signal passes from each said transfer strip to each said transfer tip in electrical contact therewith and thence to said fastener to place said fastener in its unlocked position.

21. The apparatus of claim 20, wherein each said transfer tip is electrically connected to said fastener by a respective wire, said door being selected from the group consisting of:

a) a solid core door having a portion of its core removed to contain said transfer tip assembly, such that said housing is positioned at an outer edge of said solid core door, and such that there is a channel in said core through which each wire extends and is connected to said fastener;

b) a hollow core door, wherein said transfer tip assembly is mounted in said hollow core such that said housing is positioned at an outer edge of said hollow core door, and such that each wire extends through said hollow core and is connected to said fastener; and c) a door fabricated from a hollow tubular door frame with at least one solid door panel therewithin, such that said housing is mounted in a portion of said tubular door frame at an outer edge of said door and such that there is a hollow portion of said tubular door frame that is proximal to said fastener through which each wire extends and is connected to said fastener.

22. The apparatus of claim 20, wherein the signaling device is a remote control device, and wherein said signal application structure includes a receiver for receiving the deactuation signal wirelessly from the remote control device and an electrically conductive wire structure for connecting said receiver to said at least one transfer strip.

23. A method of transferring an electrical deactuation signal from a signaling device to an electrically deactuable fastener mounted in a first mechanical component, the fastener having an actuated condition for maintaining the first mechanical component and a second mechanical component unmoving with respect to each other in a defined configuration and a deactuated condition for permitting the first component to move with respect to the second component, said method comprising the steps of:

mounting a transfer tip assembly in the first component, the transfer tip assembly including a housing and at least one elongated electrically-conducting transfer tip, each transfer tip having a proximal end and a distal end and being slidably mounted in a respective channel within the housing for movement between a first position and a second position, the housing being mounted in the first component at a first surface thereof, each transfer tip at its first position presenting its distal end through the first surface and outside of the first component by a first distance and at its second position presenting its distal end by no more than a second distance outside of the first component less than the first distance, the proximal end remaining within the respective channel in all positions of the transfer tip, each transfer tip being normally biased to its first position, and each transfer tip being electrically connectable to the fastener for providing the deactuation signal thereto;

mounting a transfer strip assembly including at least one electrically conductive transfer strip on the second component at a second surface thereof facing the first surface of the first component such that when the first and second components are in the defined configuration and the fastener is in its actuated condition, each transfer tip is in its first position with its distal end in electrical contact with a respective transfer strip, the transfer strip assembly being mounted such that when each transfer tip is in its second position it is out of electrical contact with the transfer strip assembly;

receiving the deactuation signal from the signaling device; and applying the deactuation signal received from the signaling device to each transfer strip by passing the deactuation signal from each transfer strip to each transfer tip in electrical contact therewith and thence to the fastener to place the fastener in its deactuated condition.

24. The method of claim 23, wherein the signaling device is a remote control device, and wherein said applying step includes the step of receiving the deactuation signal wirelessly from the remote device and the step of electrically passing the received deactuation signal to the at least one transfer strip.

* * * * *